US006702014B1

(12) United States Patent
McGarian et al.

(10) Patent No.: US 6,702,014 B1
(45) Date of Patent: Mar. 9, 2004

(54) DEFLECTOR TOOL FOR DEFLECTING ITEMS THROUGH A WINDOW IN BOREHOLE CASING

(75) Inventors: Bruce McGarian, Aberdeen (GB); Ian Gillies, Angus (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/744,337

(22) PCT Filed: Jul. 20, 1999

(86) PCT No.: PCT/GB99/02353

§ 371 (c)(1),
(2), (4) Date: Mar. 8, 2001

(87) PCT Pub. No.: WO00/08294

PCT Pub. Date: Feb. 17, 2000

(30) Foreign Application Priority Data

Aug. 3, 1998 (GB) ..... 9816888

(51) Int. Cl.[7] ..... E21B 23/12
(52) U.S. Cl. ..... 166/117.6; 166/215; 166/217
(58) Field of Search ..... 166/117.6, 117.5, 166/209, 211, 215, 217, 50, 55.7, 298; 175/61, 81

(56) References Cited

U.S. PATENT DOCUMENTS

| | | | | |
|---|---|---|---|---|
| 2,145,422 A | | 1/1939 | Kinzbach | |
| 3,095,039 A | | 6/1963 | Kinzbach | |
| 4,153,109 A | * | 5/1979 | Szescila | 166/382 |
| 4,429,741 A | * | 2/1984 | Hyland | 166/63 |
| 5,472,048 A | * | 12/1995 | Kennedy et al. | 166/50 |
| 5,878,818 A | * | 3/1999 | Herbert et al. | 166/382 |
| RE36,526 E | * | 1/2000 | Braddick | 166/297 |

FOREIGN PATENT DOCUMENTS

| | | |
|---|---|---|
| GB | 2334734 | 9/1999 |
| WO | 9523274 | 8/1995 |

* cited by examiner

*Primary Examiner*—Zakiya Walker
(74) *Attorney, Agent, or Firm*—Dykema Gossett PLLC

(57) ABSTRACT

A well bore deflector tool which is used primarily for deflecting tools, lining and the like through a window which has been milled in the side of a well bore casing includes a deflector face (3) at an upper end thereof and slips (9, 10) for selectively gripping and releasing a tie back receptacle (8) and/or a well bore casing (6) at a location below the deflector face (3). The slips are operable for gripping in response to engagement of the deflector tool (1) with a tie back receptacle (8). Accordingly, the invention provides a simple and automatic device for locking the deflector tool in a required angular position.

7 Claims, 1 Drawing Sheet

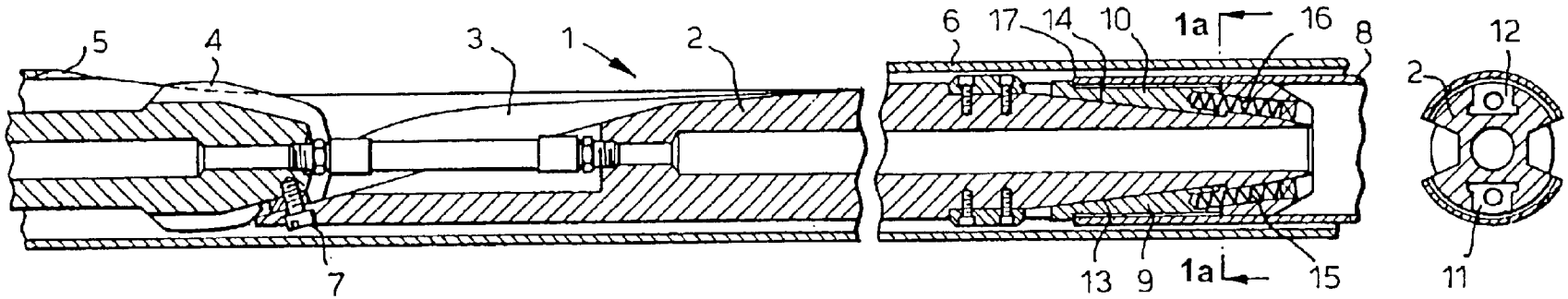
Fig.1.
Fig.1a
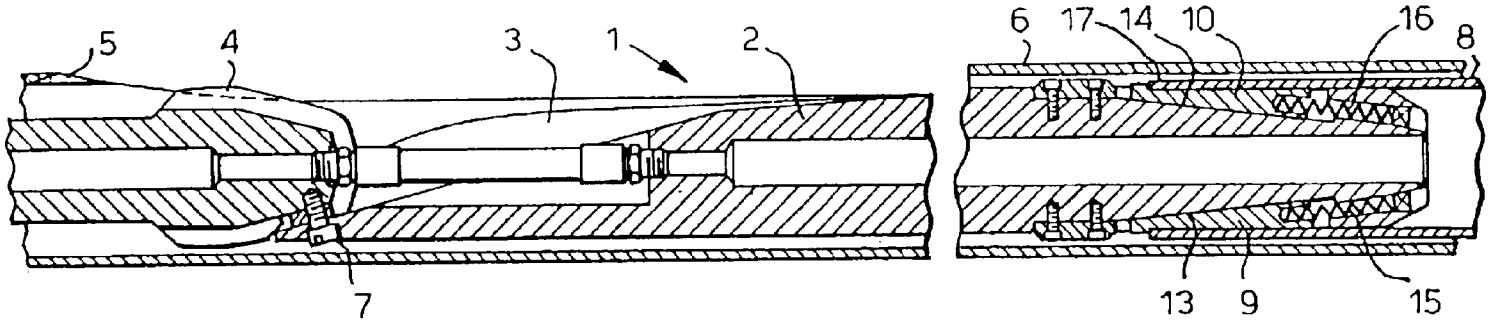
Fig.2.

DEFLECTOR TOOL FOR DEFLECTING ITEMS THROUGH A WINDOW IN BOREHOLE CASING

BACKGROUND OF THE INVENTION

1. Field of the Invention

This invention relates to a deflector tool, that is to say, a tool for deflecting laterally of a borehole an item passing through a borehole. Deflector tools are used particularly for deflecting tools, lining and the like through a window which has been milled in the side of the casing of a well bore.

2. The Prior Art

A deflector tool includes a deflector face which acts to guide the item to be deflected in the correct direction. Clearly, it is important that the deflector face is correctly oriented relative to the required deflector direction. For example, if an item is to be deflected through a window already milled in a casing, it is important that the deflector face is rotationally aligned so as to direct the object in question through the window.

In some instances correct rotational alignment of the deflector tool is facilitated by the fact that a rotational reference point is fixed by a tool already present in the well bore. For example, a packer having a rotational reference groove may be positioned below the window, and if this is the case, the deflector tool can be correctly oriented using the rotational reference already present. In many cases, however, no convenient rotational reference point will be available, and under these circumstances it is necessary to rotationally align the deflector tool by suitable means, and then lock it relative to the casing so that it can perform its deflector function correctly. Locking can be effected by means of a suitable packer, but if a packer is used it must be set, possibly by means of a separate packer run, and must be retrieved after the deflector tool has been used. Deflector tools are used particularly for deflecting tools, lining and the like through a window which has been milled in the side of the casing of a well bore.

A deflector tool includes a deflector face which acts to guide the item to be deflected in the correct direction. Clearly, it is important that the deflector face is correctly oriented relative to the required deflector direction. For example, if an item is to be deflected through a window already milled in a casing it is important that the deflector face is rotationally aligned so as to direct the object in question through the window.

In some instances correct rotational alignment of the deflector tool is facilitated by the fact that a rotational reference point is fixed by a tool already present in the well bore. For example, a packer having a rotational reference groove may be positioned below the window, and if this is the case the deflector tool can be correctly oriented using the rotational reference already present. In many cases, however, no convenient rotational reference point will be available and under these If a tie back receptacle (TBR) is present in the well the present invention enables the TBR to be used to lock the deflector tool in the required rotational position during use. The deflector tool is, however, easily removed from the well after use without disturbing the TBR.

SUMMARY OF THE INVENTION

Accordingly, one aspect of the present invention provides a deflector tool comprising a deflector face at the upper end thereof and means for selectively gripping and releasing a tie back receptable and/or a well bore casing at a location below the deflector face, the means being operable for gripping in response to engagement of the deflector tool with a tie back receptacle when in use, the deflector tool being characterized in that the gripping means comprise slips which are biased into a retracted position but which are movable to an expanded position in which they can grip the interior of the TBR and/or well bore casing to prevent rotation of the deflector tool.

In the preferred embodiment of the invention, means are provided for automatically moving the slips into engagement with the interior of the TBR and/or well bore casing as the deflector tool is run into the TBR, and for releasing the slips from the TBR and/or well casing as the deflector tool is pulled from the TBR. In the preferred embodiment of the invention the slips are formed with shoulders which engage the end face of the TBR to prevent her movement of the slips. Preferably, the deflector tool is arranged so that, when in use, the shoulders engage the TBR only after at least part of the gripping portions of the slips have entered the interior of the TBR. The body of the deflector tool defines cam surfaces which act on complementary cam surfaces provided on the slips such that the further downward movement of the deflector tool body after the slips shoulders have engaged the end of the TBR will cam the slips outward into engagement with the interior of the TBR. Alternatively, the arrangement may be such that the slips are cammed into engagement with either, both the interior of the TBR and the well bore casing, or, just the well bole casing. Furthermore, when the deflector tool is pulled the cam force will bee released and the slips can be retracted away from the interior of the TBR and/or well bore casing by the biasing means.

The invention accordingly provides a simple and automatic means for locking the deflector tool in the required angular position.

Rotation of the tool to the correct angular position can be achieved by any conventional means, for example by use of a MWD tool.

The deflector tool may be made up with a mill so that the deflector tool and mill may be run into casing together and, after setting of the deflector tool, the mill may be released to enter the casing window and effect milling thereof.

In an alternative arrangement, the slips are set within the TBR by hydraulic force transmitted from the surface to a slip actuator.

The invention will be better understood from the following description of a preferred embodiment thereof, given by way of example only, reference being had to the accompanying drawings, wherein:

BRIEF DESCRIPTION OF THE DRAWINGS

FIG. 1 shows schematically a deflector tool according to the present invention as it is being run into a TBR;

FIG. 1*a* is a view along line 1*a*—1*a* of FIG. 1; and

FIG. 2 shows the tool of FIG. 1 after the slips have been set.

DETAILED DESCRIPTION OF THE PREFERRED EMBODIMENT

Referring to the drawings, the deflector tool 1 comprises a body 2 defining a deflector face 3. The tool is typically used for deflecting a piece of equipment, for example a re-entry mill 4 through an existing window 5 formed in a well casing 6. As illustrated, the mill 4 is secured to the body 2 of the deflector tool 1 by a shear bolt 7 so the deflector tool and re-entry mill may be run as a unit into the casing 6.

At a location somewhat below the window 5 a tie back receptable (TBR) 8 is positioned. As will be appreciated by those skilled in the art, the TBR 8 is rotationally and axially fast with the casing 6.

The body 2 carries, adjacent the lower end thereof, two slips 9,10. The slips have serrated outer faces for gripping the interior of the TBR and are generally T-shaped in cross-section so that they are constrained to move within T-shaped slots 11, 12 provided in the body 2. The bottom walls 13, 14 of the slots 11, 12 slope relative to the longitudinal axis of the tool to provide cam surfaces for acting on the interior surfaces of the slips 9, 10. The slips 9, 10 are biased towards the bottom of the tool by return springs 15, 16. The upper end of each slip is formed with a shoulder which is positioned to engage the upper end 17 of the TBR as the deflector tool is run into the TBR. In an alternative embodiment, the slips may be configured with serrated outer faces located above the shoulder for engagement with the well bore casing 6. These serrated faces may be provided in addition to those located below the shoulder or as an alternative thereto.

It will be appreciated from the above that, when the slips are in the lowest possible position relative to the body 2 (under the influence of the return springs 15, 16), the external diameter of the deflector tool 1 at the lower end thereof is somewhat less than the internal diameter of the TBR. Accordingly, the lower end of the tool can be run freely into the TBR. However, when the shoulders on the slips engage the upper end 17 of the TBR, further inward movement of the slips relative to the TBR will be prevented. Continued downward movement of the body 2 will accordingly move the body 2 relative to the slips 9, 10 against the bias of the return springs 15, 16. The cam surfaces 13, 14 will force the slips 9, 10 radially outwardly to grip the interior of the TBR.

In order to release the deflector tool it is merely necessary to exercise an upward force on the deflector tool. This will pull the body 2 upwardly relative to the slips, which will then slide back down the cam surfaces 13, 14 under the influence of the return springs 15, 16. This will move the gripping surfaces of the slips radially inwardly and the tool can readily be withdrawn from the TBR.

In use, the deflector tool may be run into the well in a separate trip or run in with other components such as the mill 4. When the bottom of the deflector tool is just above the level of the TBR, the deflector tool will be rotated as required to the correct angular alignment. This may be done using conventional MWD unit techniques. The string is then lowered further to engage the lower end of the deflector tool in the TBR and set the slips as described above. The deflector tool may then be used, e.g., by exerting a substantial downward force to shear the shear bolts 7 to allow milling by means of the tool 4 to commence. When the TBR is no longer required, it can readily be removed from the well as described above.

It will be appreciated that downward force applied to the deflector tool in use will tend to increase the grip of the slips 9, 10 with the TBR.

If desired, circulation can be provided by means of appropriate fluid ways for cleaning the TBR prior to insertion of the deflector tool. The arrangement illustrated in the accompanying drawings incorporates a flexible circulation connector for connecting the fluid way of the mill 4 with that of the deflector tool 1. The connector comprises a shear element (not shown) for assisting in the separation of the mill 4 and deflector tool 1 prior to milling. In an alternative arrangement, the fluid ways may be offset from the longitudinal axis of the downhole equipment so that a direct connection of the mill 4 and deflector tool 1 fluid ways may be provided adjacent the shear bolts 7. Such an arrangement obviates the need for the flexible connector.

Whilst the above described mechanical setting arrangement is preferred, it will be appreciated that appropriate means may be provided for hydraulically setting the slips within the TBR if so required.

What is claimed is:

1. A deflector tool for use in a well bore having a casing and containing a tie back receptacle, the deflector tool comprising a deflector face at an upper end thereof and gripping means for selectively gripping and releasing at least one of said tie back receptacle and said well bore casing at a location below the deflector face, the gripping means comprising slips which are biased into a retracted position but which are movable to an expanded position in which they grip an interior of at least one of said tie back receptacle and said well bore casing so as to prevent rotation of the deflector tool, wherein the slips include shoulders for engaging said tie back receptacle when said slips are in the retracted position so as to move to the expanded position.

2. A deflector tool as claimed in claim 1, including return springs for biasing the slips into the retracted position, the return springs applying a force acting in a direction in which the slips move when moving from the expanded to the retracted position.

3. A deflector tool as claimed in claim 1 or 2, wherein means are provided for releasing the slips from at least one of said tie back receptacle and said well bore casing as the deflector tool is pulled from with which the shoulders are engaged.

4. A deflector tool as claimed in claim 1or 2, wherein the slips are arranged so as to be cammed into engagement with the interior of at least one of said tie back receptacle and said well bore casing.

5. A deflector tool as claimed in claim 1 or 2, wherein said shoulders are engageable in use with an end face of said tie back receptacle as the deflector tool is run into said tie back receptacle so as to prevent longitudinal movement of the slips relative to said tie back receptacle in the event of the deflector tool being run further into said tie back receptacle.

6. A deflector tool as claimed in claim 5, wherein cam surfaces are defined on a body of the deflector tool which act on complementary cam surfaces provided on the slips such that, once the slips shoulders have engaged the end of the back receptable during use, further running of the deflector tool into the back receptable cams the slips outward into the expanded position.

7. A deflector tool as claimed in claim 5, wherein the slips are arranged so that, when in use, the shoulders engage said tie back receptacle only after at least part of gripping portions of the slips have entered the interior of said tie back receptacle.

* * * * *